US005979086A

United States Patent [19]

Vindriis

[11] Patent Number: 5,979,086

[45] Date of Patent: Nov. 9, 1999

[54] INSOLE HAVING MULTIPLE FLUID-CONTAINING CHAMBERS

[76] Inventor: Soeren Vindriis, Tulipanparken 43, DK-8700 Horsens, Denmark

[21] Appl. No.: 08/981,523

[22] PCT Filed: Jul. 15, 1996

[86] PCT No.: PCT/DK96/00323

§ 371 Date: Dec. 19, 1997

§ 102(e) Date: Dec. 19, 1997

[87] PCT Pub. No.: WO97/03583

PCT Pub. Date: Feb. 6, 1997

[30] Foreign Application Priority Data

Jul. 14, 1995 [DK] Denmark ..... 0827/95

[51] Int. Cl.[6] ..... A43B 7/14; A43B 13/38

[52] U.S. Cl. ..... 36/153; 36/43

[58] Field of Search ..... 36/43, 44, 28, 36/29, 153, 93

[56] References Cited

U.S. PATENT DOCUMENTS

| | | | |
|---|---|---|---|
| 1,219,890 | 3/1917 | West | 36/44 |
| 2,177,116 | 10/1939 | Perschino | 36/44 |
| 2,677,906 | 5/1954 | Reed . | |
| 2,762,134 | 9/1956 | Town | 36/153 |
| 3,724,106 | 4/1973 | Magidson | 36/44 |
| 3,922,801 | 12/1975 | Zente | 36/44 |
| 4,123,855 | 11/1978 | Thedford | 36/44 |
| 4,864,737 | 9/1989 | Marrello | 36/29 |
| 4,999,931 | 3/1991 | Vermeulen | 36/29 |
| 5,778,561 | 7/1998 | Shimoyama | 36/43 |

FOREIGN PATENT DOCUMENTS 2152710 1/1973 Germany .

*Primary Examiner*—B. Dayoan

*Attorney, Agent, or Firm*—Watson Cole Grindle Watson, PLLC

[57] ABSTRACT

An insole relieves foot, knee, hip, and back pressures in a standing position of rest and in motion during walking or running, at the same time as a massage effect and pressure equalization are obtained in a standing position of rest. The sole includes a first chamber (5) filled with fluid and at least one second chamber (7, 8) filled with fluid. The first fluid-containing chamber (5) is preferably provided between the intermediate foil (2) and the topfoil (1). In a preferred embodiment the insole according to the invention includes additional chambers (25, 26) arranged in a central part (20), respectively along an inner side (21) of the insole, and having a convex surface (29, 30). The insole according to the invention makes it possible with just one insole to provide the foot with relief of both shocks and pressure equalization during walking or running, at the same time as a massage effect and pressure equalization are provided in a standing position of rest.

15 Claims, 6 Drawing Sheets

INSOLE HAVING MULTIPLE FLUID-CONTAINING CHAMBERS

BACKGROUND OF THE INVENTION

The present invention relates to an insole for footwear, the sole including a topfoil and a backfoil, which are joined along their respective edge areas to form a first closed chamber between the topfoil and the backfoil, the first chamber being filled with a fluid, and the sole also including at least one intermediate foil arranged between the topfoil and the backfoil and joined with the topfoil and the backfoil along edge areas.

THE PRIOR ART

U.S. Pat. No. 4,115,934 describes an insole produced from a plastic material and including a first chamber filled with fluid. The sole further includes second chambers filled with fluid and having a sealed periphery and positioned completely within the periphery of the first chamber but separated from the first chamber. The second chambers may be provided in a front, central or rear part of the sole. However, this insole has the disadvantage that the individual chambers are completely separated. This is a disadvantage if the foot is to be relieved in the form of shock absorption or massage of the foot. A fluid contained in a limited chamber is only able to relieve impacts in the form of static pressure.

U.S. Pat. No. 4,567,677 also describes an insole. The sole also includes a first chamber filled with fluid. The sole further includes flow barriers provided in the central part of the sole. The flow barriers extend in two C-shapes to form further four flow channels and a large inner flow channel in the central part of the sole. However, this insole has the disadvantage that no independent chambers exist having fluid in complete separation from the rest of the fluid. This is a disadvantage if the foot is to be relieved of pressure when the person is moving. A fluid that is able, freely or subject to a few restrictions in the form of barriers, to flow freely in the entire extension of the sole, will be pressed away from the load area by the person's movement, meaning that such a sole is only able to relieve impacts requiring a shock absorption when walking or running or requiring a massage effect.

U.S. Pat. No. 4,864,737 describes a sole for a shoe, having a plurality of first and second chambers separated by a foil between the chambers. The first chamber contains a liquid and the second fluid contains a gas. During walking, the incompressible liquid will level out pressure differences in the foot, and the liquid flow in the first chamber may vary by pressure equalisation with the gas in the second chamber.

However, this sole has the disadvantage that the pressure relief taking place is not controlled, i.e., the pressure equalisation cannot be directed towards specific parts of the foot which may need specific pressure equalisation or relief. The gas has to be contained in the chamber in order to establish a pressure equalisation at all in that known sole, but it leads to a pressure equalisation that is out of control.

Thus, there is a direct incompatibility of soles being able to equalise pressure differences in limited portions of the sole of the foot and soles being able to shock absorb or massage the foot. In order to obtain the desired pressure equalisation, the former comprise delimited chambers filled with fluid whereas in order to obtain the desired shock absorption and massage effect, the latter do precisely not comprise delimited fluid chambers but rather one large chamber in which the fluid may flow over flow barriers from one end of the sole to the other.

Consequently, it is not possible with the soles known hitherto to provide a sole that is able to provide the foot with pressure equalisation in a standing position of rest and in motion while at the same time the sole is able to provide the foot with shock absorption and a massage effect. U.S. Pat. No. 4,567.677 attempts to solve this problem by providing barriers around the middle of the sole so that the front and rear parts of the sole show similarity with delimited fluid chambers. However, this means that the various types of relief of the foot fail to be optimal since U.S. Pat. No. 4,567,677 discloses a compromise solution.

It is the object of the present invention to provide a sole that does not possess the above-mentioned disadvantages and, thus, provides the foot with optimal relief of all types of impacts on the foot and not just certain types of impacts on the foot.

This object is obtained by the present invention, which is characterised in that the intermediate foil is joined with the topfoil along delimiting lines to form at least one second closed chamber between the intermediate foil and the topfoil, and that the second chamber is also filled with a fluid.

A sole that possesses these characteristics is able in an optimal way to provide the foot with relief of both pressure loads in a standing position of rest and in motion in the form of walking or running as well as shocks during walking or running along with the establishment of a massage effect.

The object is further obtained by an insole characterised in that the intermediate foil is joined with the backfoil along delimiting lines to form at least one second closed chamber between the intermediate foil and the backfoil, and that the second chamber is also filled with a fluid.

The topfoil, the intermediate foil and the backfoil are preferably produced from plastic. The first chamber is preferably arranged between the intermediate foil and the backfoil, and the at least one second chamber between the intermediate foil and the topfoil. It will also be possible, however, to arrange the first chamber between the intermediate foil and the topfoil and the at least one second chamber between the intermediate foil and the backfoil.

Throughout the present disclosure the terms topfoil, intermediate foil and backfoil will be used to designate an insole having two outer foils and an intermediate foil. Thus, the term topfoil and the term backfoil are not to be considered as a limitation of the insole according to the invention. Thus, foil being designated as topfoil may be used as backfoil, and foil being designated as backfoil may be used as topfoil.

In a preferred embodiment at least the first chamber is provided with joints of the backfoil and the intermediate foil, alternatively the topfoil and the intermediate foil. The joints are provided over part of the extension of the sole to create restrictions on the flow of liquid in the first chamber so that the flow speed in the first chamber is reduced.

In a second preferred embodiment a delimiting line is formed between an area of the sole intended to contact the forefoot and an area of the sole intended to contact the toes. A second delimiting line is formed between an area intended to contact the metatarsus and an area intended to contact the heel.

DESCRIPTION OF THE DRAWINGS

The invention will now be described in detail with reference to the accompanying drawing, wherein.

DETAILED DESCRIPTION OF THE PREFERRED EMBODIMENT

Figure 1:
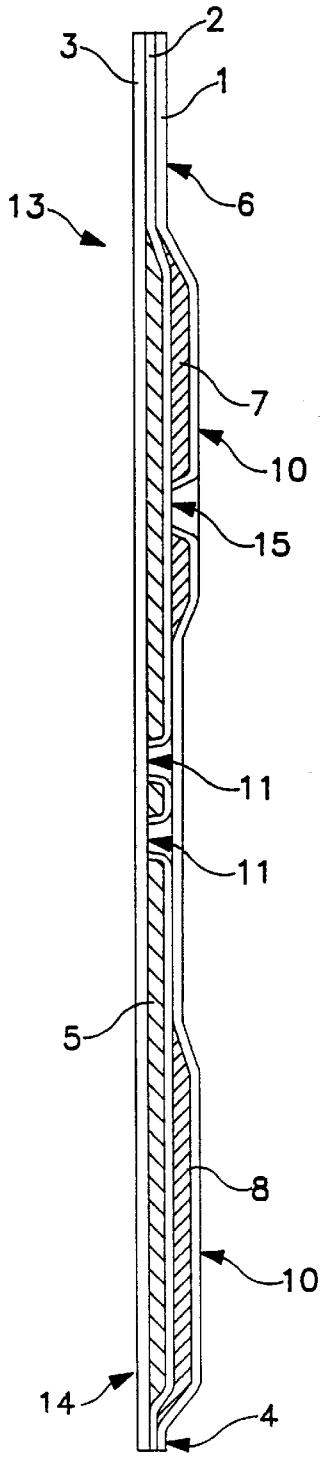
FIG. 1 is a sectional view of a first embodiment of a sole according to the invention.

FIG. 1 illustrates an embodiment of a sole according to the invention. The sole consists of three layers of foil, a topfoil or outer layer 1, an intermediate foil or layer 2 and a backfoil or outer layer 3, respectively. The topfoil 1 is intended to contact the foot of a person wearing footwear having the insole arranged inside, whereas the backfoil is intended to contact the inner sole of the shoe. The topfoil 1, the intermediate foil 2 and the backfoil 3 of the embodiment shown extend in the entire extension of the sole in a length L and a width B.

The topfoil 1, the intermediate foil 2 and the backfoil 3 are respectively joined along their peripheries, i.e., at edge area 4. The foils 1, 2, 3 of the embodiment shown are produced from plastic and the joints have been established by welding the foils.

Between the backfoil 3 and the intermediate 2 a first or primary fluid chamber 5 is formed in the bottom part of the sole. The first fluid chamber 5 extends substantially the entire length L of the sole except for the flat area 6 at the front end of the insole intended to contact the toes on the foot of the person wearing footwear with the insole arranged inside.

Between the topfoil 1 and the intermediate foil 2 at least one second or secondary fluid chamber 7 is formed in the upper part of the sole, in the embodiment shown two second fluid chambers 7, 8. The second fluid chambers 7, 8 are formed by joining the intermediate foil 2 and the topfoil 1 along delimiting lines 9, 9*a* and along the edge area 4 (see FIG. 2) so that these are respectively designed to contact a foot ball, and a heel, of the person wearing footwear with the insole arranged inside. Other positions or further positions of the second fluid chambers 7, 8 may be provided, however, e.g., one or several fluid chambers may be formed under the metatarsus of the person in question.

The second fluid chambers are filled with fluid at a given pressure, which in the embodiment shown means that an upper side 10 of the topfoil 1 is plane at the second fluid chambers 7, 8 in an unloaded condition. However, it will also be possible to fill in liquid at a higher pressure so that the upper side of the topfoil is convex at the second fluid chambers 7, 8 in an unloaded condition.

Figure 2:
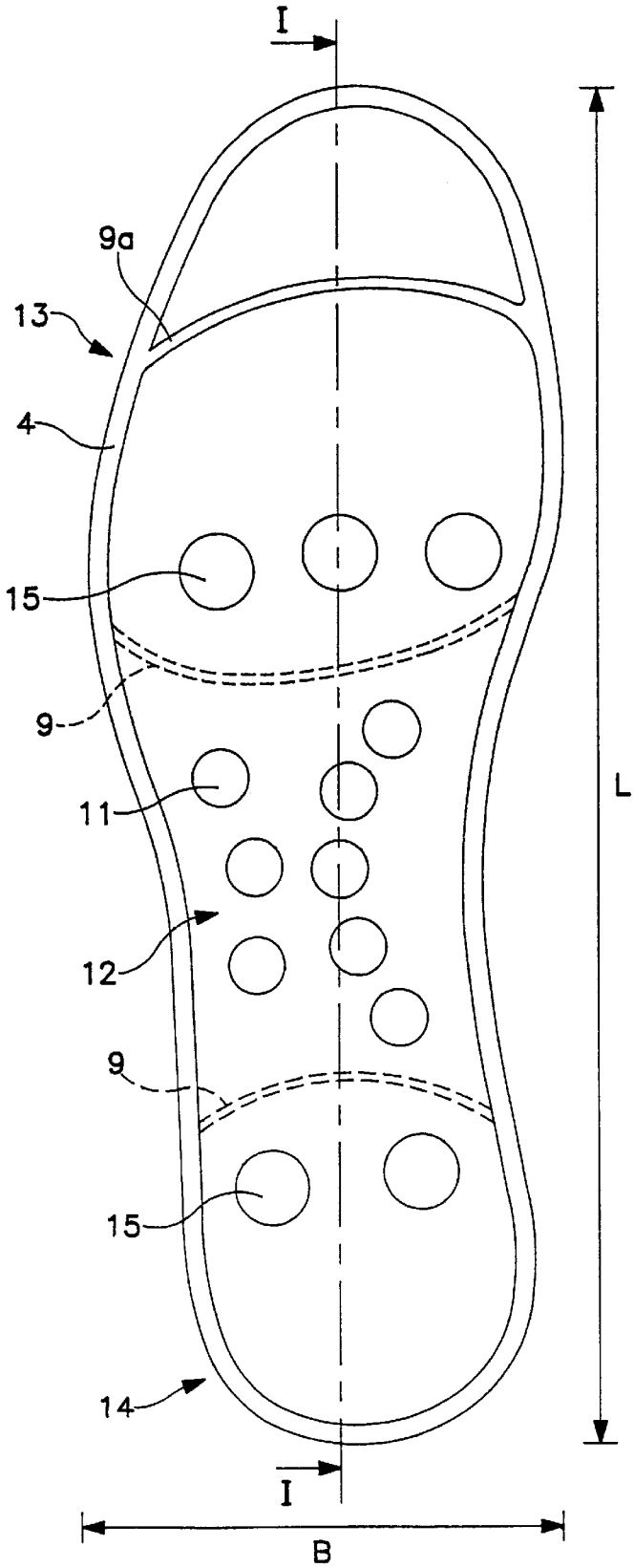
FIG. 2 is a plan view of the first embodiment of the sole according to the invention.

In the first chamber 5, joints 11 between at least the intermediate foil 2 and the backfoil 3, alternatively also the topfoil 1, are provided in an area 12 at the metatarsus (see FIG. 2). The joints 11 are formed as embossings, but other embodiments of the joints may be established. The joints 11 are established to prevent the liquid in the first chamber 5 from collecting under the metatarsus and to.

The joints 15 are formed as embossings, but other embodiments of the joints 15 may be provide two shock absorbing functions by reducing the flow speed of the fluid as the fluid flows back and forth between the front area 13 and the rear area 14 of the sole, i.e., forward in the sole during load on the heel and backward in the sole during load on the forefoot. In the second chambers 7, 8 corresponding joints 15 may also be provided between the topfoil 1 and the intermediate foil 2, possibly through to the backfoil 3.

FIG. 2 illustrates the embodiment of the sole according to the invention shown in FIG. 1. The topfoil 1, the intermediate foil 2 and the backfoil 3 (see Fig. 1) are joined, as mentioned, along the respective edge areas 4 of the foils. The intermediate foil 2 (see FIG. 1) is joined along the delimiting lines 9, 9*a* preferably with the topfoil 1 as illustrated in FIG. 1, alternatively the backfoil 3 if the second chambers 7, 8 are established in the lower part of the sole instead of the upper part of the sole.

In the embodiment shown, as mentioned, joints 11 in the form of embossings are provided in the first chamber 5 between the intermediate foil 2 and the backfoil 3, but the embossings 11 may also be carried through all three layers of foil 1, 2, 3. Similarly, in the embodiment shown joints 15 in the form of embossings are provided in the first chamber between the intermediate foil 2 and the backfoil 3, but the embossings 15 may also be carried through all three layers of foil and thus also through the second chambers 7, 8. The area 6, which is intended to contact the toes, is not provided with fluid chambers as the toes are not subject to very heavy loads in a standing position of rest or in motion.

Figure 3:
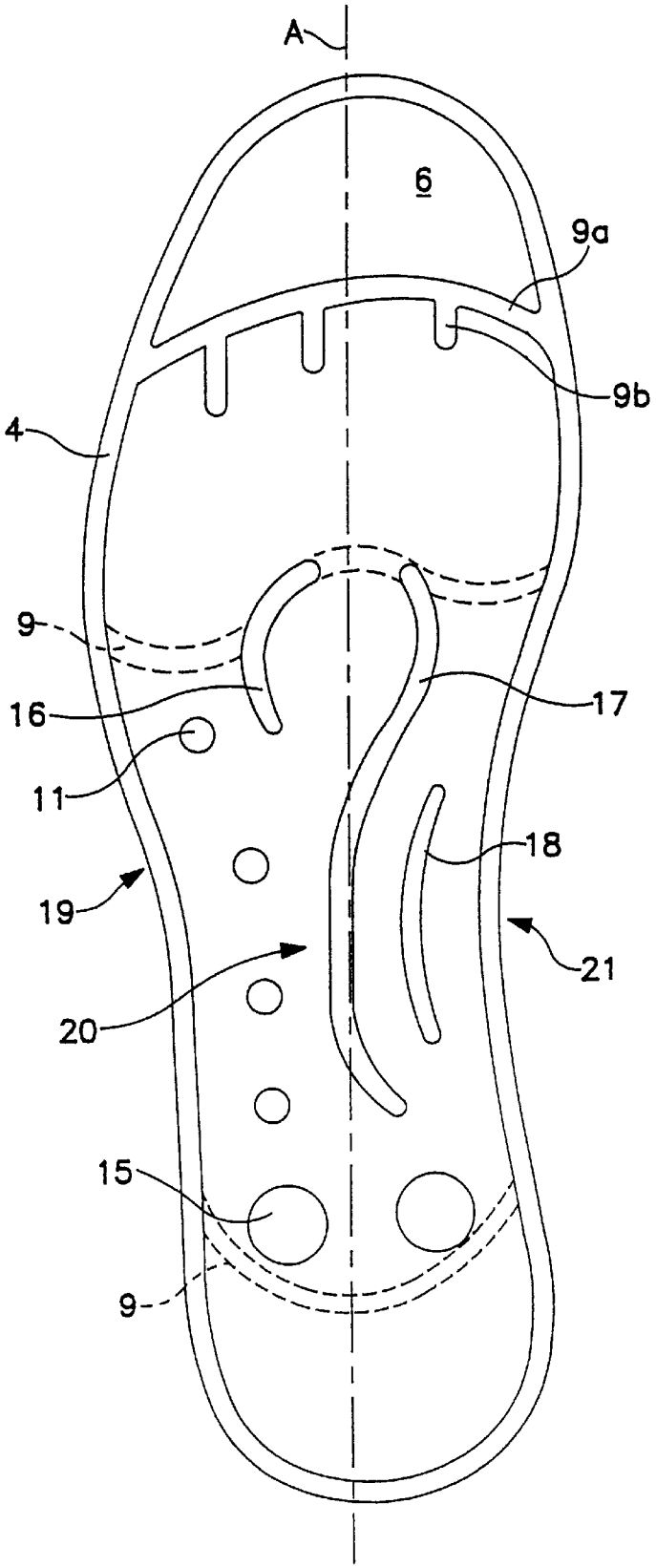
FIG. 3 is a plan view of a second embodiment of a sole according to the invention.
Figure 4:
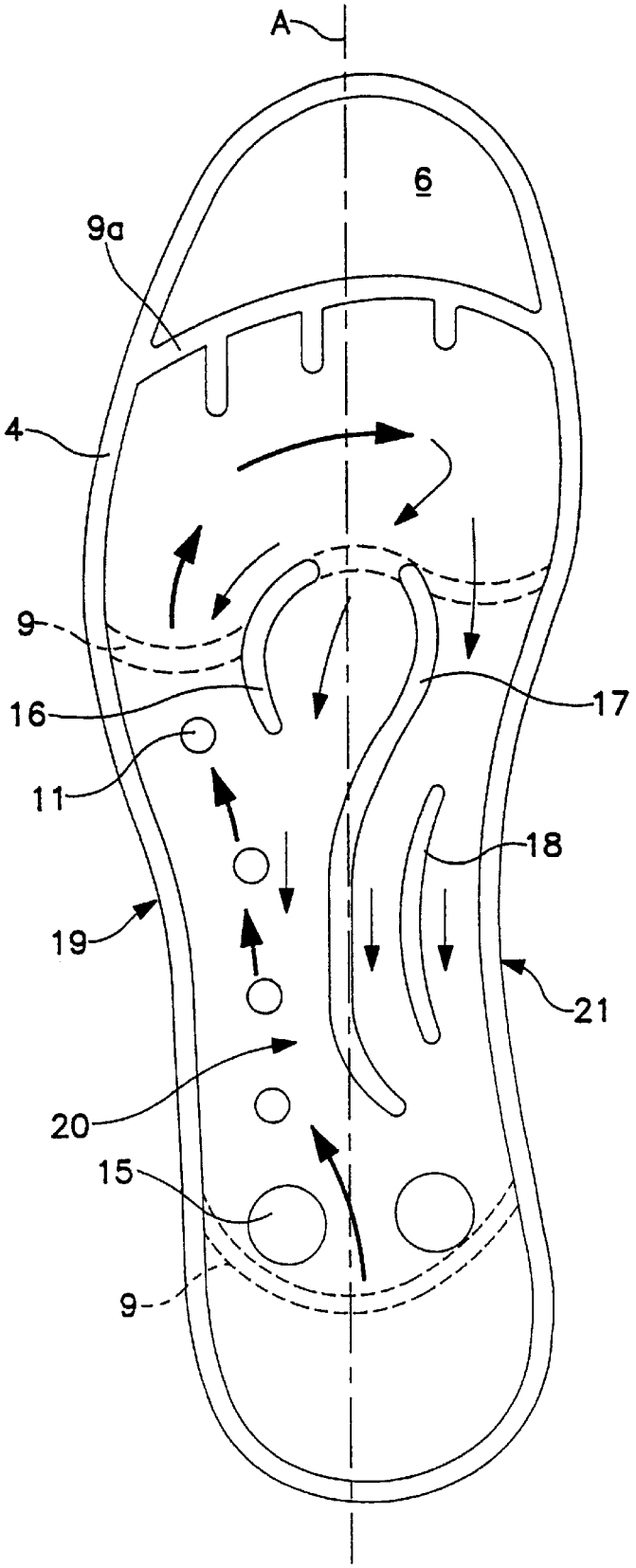
FIG. 4 is a plan view of the second embodiment according to the invention illustrating flow lines for fluid flow.
Figure 5:
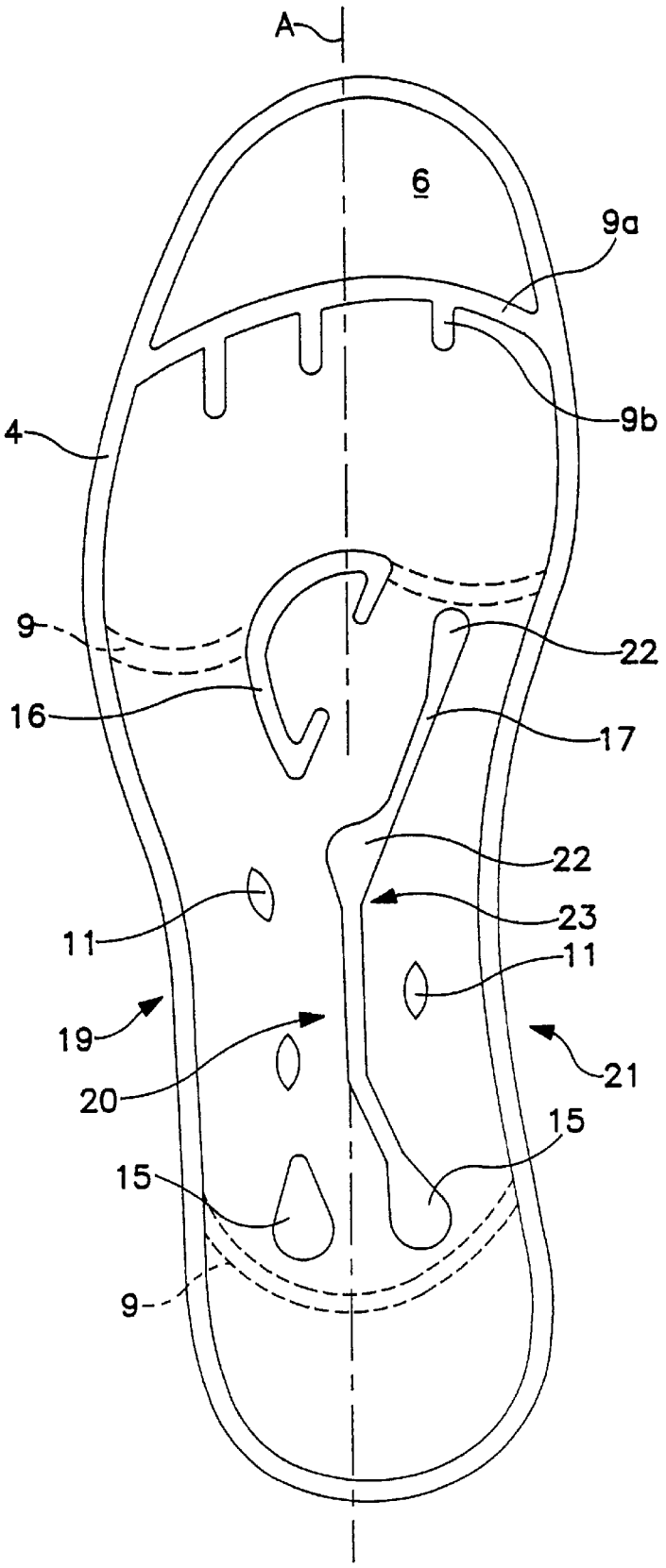
FIG. 5 is a plan view of a third embodiment of a sole according to the invention.

FIGS. 3–5 illustrate other embodiments of a sole according to the invention. The topfoil 1, the intermediate foil 2 and the backfoil 3 (see FIG. 1) are, like the sole illustrated in FIG. 1 and FIG. 2, joined along respective edge areas 4. The intermediate foil 2 is also, like the sole illustrated in FIG. 1 and FIG. 2, joined along delimiting lines 9, 9*a* with preferably the topfoil 1 as illustrated in FIG. 1, alternatively the backfoil 3 if the second chambers 7, 8 are established in the lower part of the sole instead of the upper part of the sole.

FIG. 3 illustrates joints 11, 15 in the form of embossings which in the embodiment shown are provided in the first chamber 5 and the second chamber 7 between the topfoil 1 and the backfoil 3 through the intermediate foil 2. The embossings 11, 15 may also just be provided in the second chamber 7 between the topfoil 1 and the intermediate foil 2. Correspondingly, joints in the form of joining lines 16, 17, 18 are provided in the embodiment shown in the first chamber 5 and the second chamber 7 between the topfoil 1 and the backfoil 3 through the intermediate foil 2. The joining lines 16, 17, 18 may also just be provided in the second chamber 7 carried through all three layers of foil and furthermore also through the second chambers 7, 8. The area 6, which is intended to contact the toes, is not provided with fluid chambers.

The embossings 11, 15 are circular and provided between the heel and the metatarsus as well as in the outer side 19 of the sole between the heel and the forefoot. The joining lines 16, 17, 18 have equal thickness and also extend between the heel and the forefoot both in a central area 20 of the sole and along an inner side 21 of the sole. The joining lines 16, 17 18 are divided into a first line 16, a second line 17 and a third line 18. The first line 16 extends in an arch forward toward the forefoot and inward toward a central line A of the sole. The second line 18 extends downward toward the heel from the central line A, along the central line A and further inward toward the inner side 21 of the sole. A third line extends in the central part 20 of the sole substantially parallel to the second line 17 between the forefoot and the heel. Between the forefoot and the area 6 intended to contact the toes, a delimiting line 9*a* is provided with delimiting tongues 9*b* extending from the delimiting line 9*a* backward toward the forefoot. The delimiting tongues 9*b* are intended to prevent fluid from being pressed up between the transition of the foot and the toes.

FIG. 4 illustrates that in walking the extensions of the embossings 11, 15 and the joining lines 16, 17, 18 lead to a flow of fluid between the heel and the forefoot and back toward the heel as illustrated with the arrows. The flow of fluid extends from the delimiting line 9 between the heel and the metatarsus, past the embossings 11, 15 along the outer side 19 of the sole and around the first joining line 16 such as illustrated with bold arrows. The fluid then extends back toward the heel between the joining lines 16, 17, 18 and between the outer side 19 and the inner side 21 of the sole.

FIG. 5 also illustrates embossings 11, 15, joining lines 16, 17 and delimiting tongues 9*b*. The embossings 11, 15 are oval and provided both along the outer side 19 of the sole and along the inner side 21 of the sole between the heel and the forefoot. The joint 15 is drop-shaped with the tip of the drop extending away from the heel. The joining lines 16, 17 also extend between the heel and forefoot in the central area of the sole. The joining lines 16, 17 are divided into a first line 16 and a second line 17. The first line 16 is of uniform thickness and extends in an arch forward toward the forefoot, inward and crossing the central line A of the sole. The second line 17 is provided with drop-shapes 22 and extends downward toward the heel from the inner side 21 of the sole toward the central line A of the sole, further along the central line A and farther inward toward the inner side 21 of the sole to converge with the embossing 15. Between the forefoot and the area 6, which is intended to contact the toes, the delimiting line 9*a* is provided with delimiting tongues 9*b* extending from the delimiting line 9*a* backward toward the forefoot.

The embossings 11, 15 of the embodiment shown are drop-shaped, and the joining line 17 of the embodiment shown is provided with drop-shapes 22 in ends of the line 17 and in a first bend 23 of the line. Designing the embossings 11, 15 and the joining line 17 in this manner, a more noiseless flow of fluid is obtained as a spread of the fluid flowing past the embossings 11, 15 and the joining lines 16, 17 is reduced whereby the formation of turbulence in the fluid is minimised.

Figure 6:
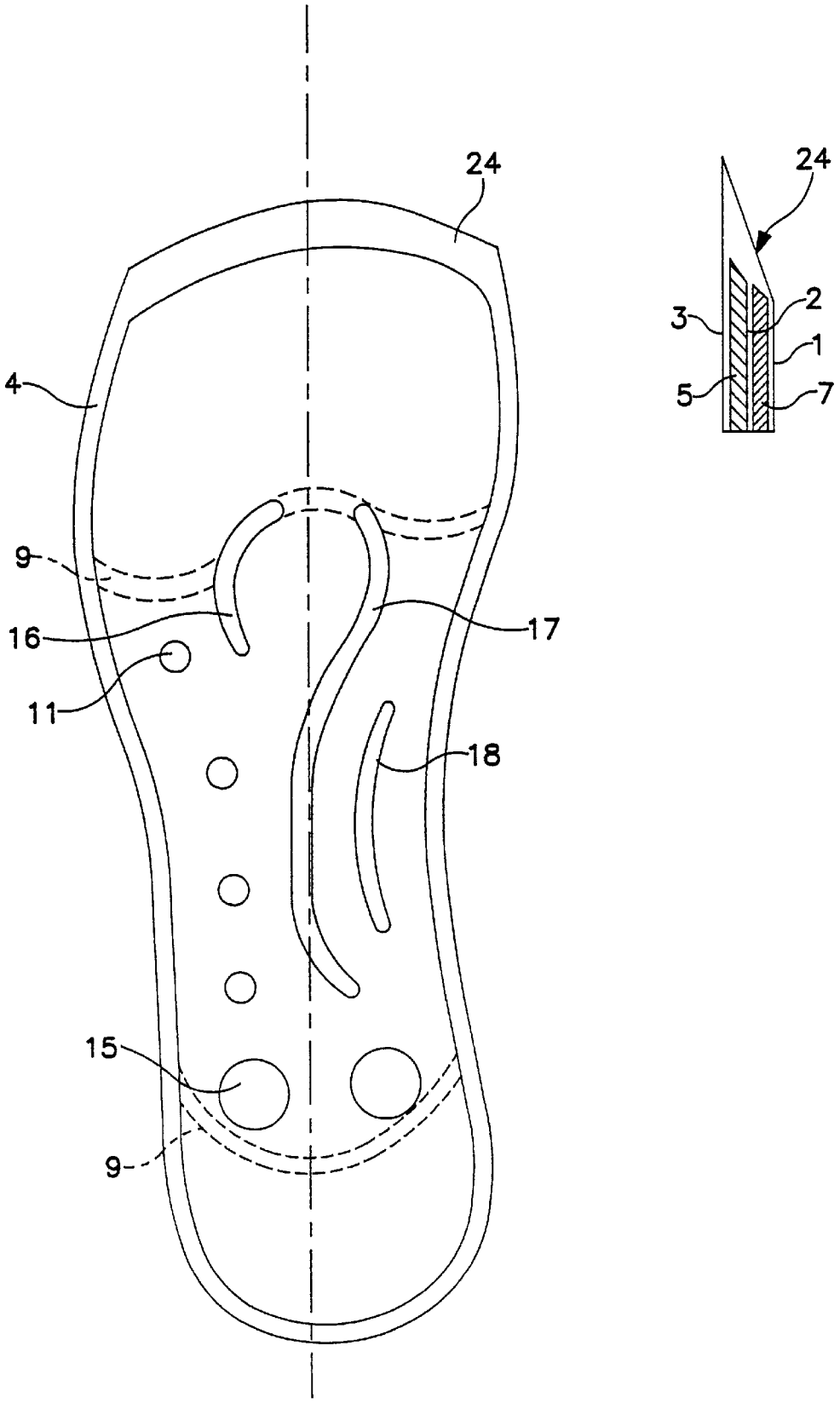
FIG. 6 is a plan view of a fourth embodiment of a sole according to the invention.

FIG. 6 illustrates a sole substantially like the sole illustrated in FIG. 3. In the embodiment shown, joints 11, 15 in the form of embossings are also provided in the first chamber 5 between the topfoil 1 and the backfoil 3 through the intermediate foil 2, but the embossings 11, 15 may also just be provided between the topfoil 1 and the intermediate foil 2 or between the intermediate foil 2 and the backfoil 3. Correspondingly, joints in the form of joining lines 16, 17, 18 are likewise provided in the first chamber 5 and the second chamber 7 between the topfoil 1 and the backfoil 3, but the joining lines 16, 17, 18 may also be provided between the topfoil 1 and the intermediate foil 2 or between the intermediate foil 2 and the backfoil 3. Unlike the embodiment shown in FIG. 3, however, the area 6 (see FIG. 3), which is intended to contact the toes, has been left out. Furthermore, the delimiting tongues 9*b* (see FIG. 3) have been left out at the same time as a bevelling 24 of the sole has been established.

Omitting the area 6, it is obtained that toes that bend strongly such as hammertoes have the largest room possible in the shoe without the sole according to the invention taking up space under the toes. The bevelling 24 causes the transition between the insole and the inner sole of the shoe not to be felt.

Figures 7, 8, 9, 10, 11:
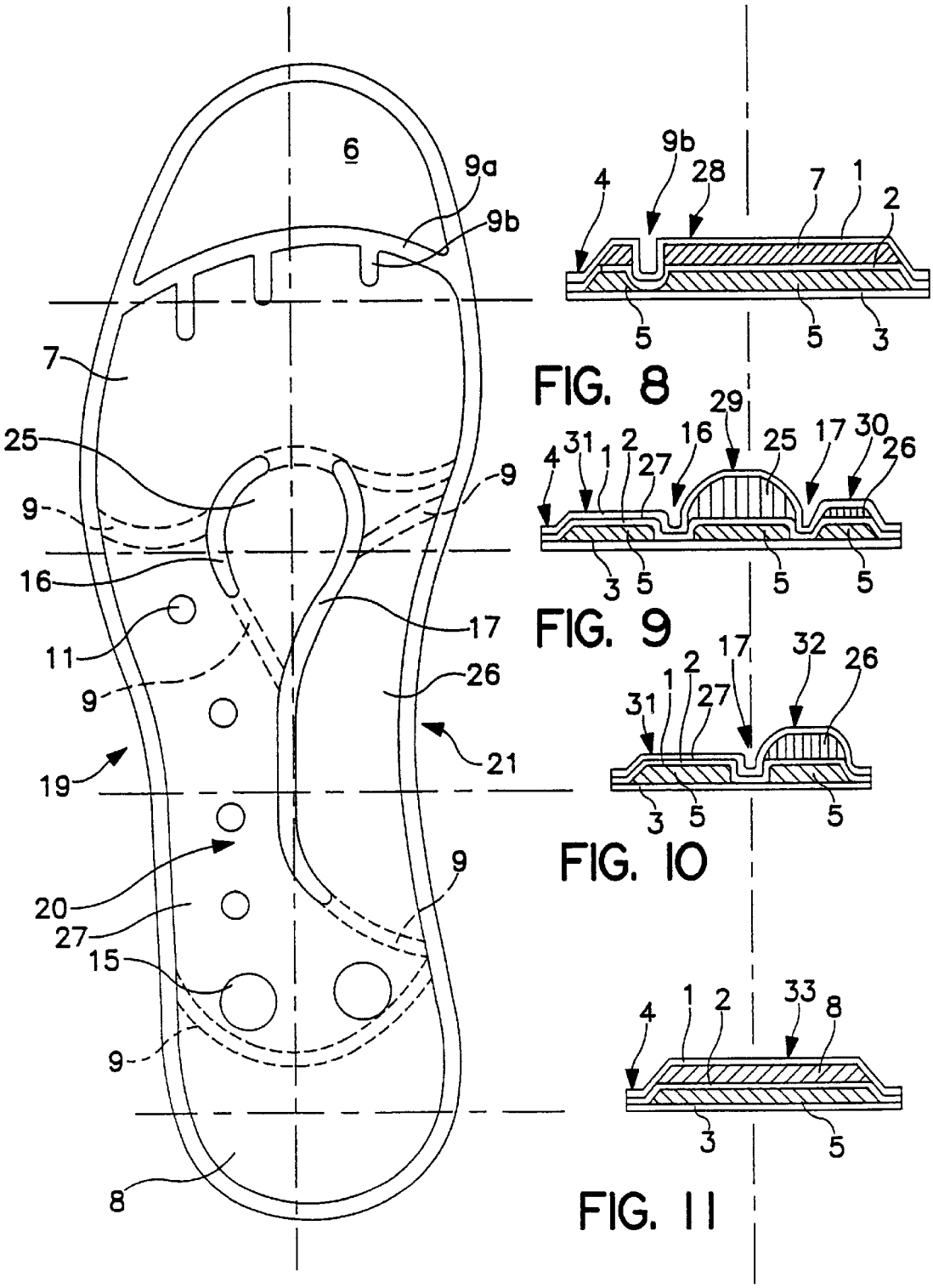
FIG. 7 is a plan view of a fifth embodiment of a sole according to the invention.
FIGS. 8–11 are sectional views of the fifth embodiment according to the invention.

FIG. 7 illustrates a sole substantially like the sole illustrated in FIG. 3 but provided with more delimiting lines 9. Providing the sole with several delimiting lines 9, it is obtained that individual partitions of second chambers 7, 8 may be established. The partitions are illustrated by second chambers 25, 26, 27. The partitions in the form of the second chambers 25, 26, 27 may have different characteristics and qualities of pressure equalisation and relief (see FIGS. 8–11). In the embodiment shown, the joints 11, 15 in the form of embossings are also provided in the first chamber 5 and second chambers 27 between the topfoil 1 and the backfoil 3 through the intermediate foil 2, but the embossings 11 may also just be provided between the topfoil 1 and the intermediate foil 2 or between the intermediate foil 2 and the backfoil 3. Correspondingly, in the embodiment shown, joints in the form of joining lines 16, 17, 18 are also provided in the first chamber 5 and the second chambers 7, 8 between the topfoil 1 and the backfoil 3 through the intermediate foil 2, but the joining lines 16, 17, 18 may also just be provided between the topfoil 1 and the intermediate foil 2 or between the intermediate foil 2 and the backfoil 3. The area 6, which is intended to contact the toes, is also illustrated.

FIG. 8 to FIG. 11 illustrate sectional views through the sole illustrated in FIG. 7. The sections are illustrated through different planes, which are all perpendicular to the central axis A of the sole. FIG. 8 is a first sectional view through a part of the sole intended to contact the forefoot. The sectional view illustrates the first chamber 5 formed between the backfoil 3 and the intermediate foil 2 and the second chamber 7 formed between the intermediate foil 2 and the topfoil 1. The second chamber 7 extends substantially in the entire width B of the sole and has a substantially plane surface 28. One of the delimiting tongues 9*b* is illustrated.

FIG. 9 is a second sectional view through a part of the sole intended to contact the metatarsus. The sectional view illustrates the first chamber 5 formed between the backfoil 3 and the intermediate foil 2 and the second chambers 25, 26, 27 formed between the intermediate foil 2 and the topfoil 1. The second chamber 25 extending in the central part 20 of the sole has a relatively strongly convex surface 29. The second chamber 26 extending along the inner side 21 of the sole has a relatively slightly convex surface 30. The second chamber 27 extending along the outer side 19 of the sole has a plane surface 31 as the second chamber 27 of the embodiment shown does not contain fluid. The joining lines 16, 17 are illustrated.

FIG. 10 is a third sectional view through a part of the sole intended to contact the arch of the foot. The sectional view illustrates the first chamber 5 formed between the backfoil 3 and the intermediate foil 2 and the second chambers 26, 27 formed between the intermediate foil 2 and the topfoil 1. The second chamber 26 extending along the inner side 21 of the sole has a relatively strongly convex surface 32 in the view shown. The second chamber 27 extending along the outer side 19 of the sole has a plane surface 31 as the second chamber 27 of the embodiment shown does not contain fluid. The joining line 17 is illustrated.

FIG. 11 is a fourth sectional view of the sole intended to contact the heel of the foot. The sectional view illustrates the first chamber 5 formed between the backfoil 3 and the intermediate foil 2 and the second chamber 8 formed between the intermediate foil 2 and the topfoil 1. The second chamber 8 extends in substantially the entire width B of the sole and has a substantially plane surface 33.

The convex surface 29, 30 of the second chambers 25, 26 is provided by applying a certain overpressure to the fluid in the second chambers 25, 26. Favourable orthopaedic qualities are obtained in the sole by giving the second chamber 25 a relatively strongly convex surface 29 along the part of sole intended to contact the centre of the metatarsus and, likewise, by giving the second chamber 26 a convex surface 30 along the part of the sole intended to contact the arch of the foot.

In the embodiments of a sole according to the invention shown in the figures, a sole is shown having a contour corresponding to most footwear. However, it will be possible to provide a sole having a different contour for special footwear, e.g. orthopaedic shoes. Thus, in the embodiment shown the sole is illustrated with the first chamber formed between the intermediate foil and the backfoil and the second chambers between the intermediate foil and the topfoil. Alternatively, the second chambers may be formed against the backfoil and the first chamber against the topfoil. The intermediate foil of the embodiment shown extends in the entire length L of the sole, but it will be possible to let the intermediate foil just extend in the same extension as the second fluid chambers are desired to extend. The number of second fluid chambers and the extensions and shapes of the fluid chambers may also be varied. Finally, the shape, the number and the positions of the joints constituting flow restrictions on the fluid in the first chamber and the second chambers, respectively, may vary.

I claim:

1. An insole for footwear which has a length and a width, which defines a forward area, a middle area, and a rearward area, and which includes a first outer layer, a second outer layer and an intermediate layer therebetween, said first, second and intermediate layers being continuously joined together at peripheries thereof, said first outer layer and said intermediate layer defining a primary chamber therebetween which contains fluid, said second outer layer and said intermediate layer being joined along separate forward and rearward lines that extend the width of said insole and joined so as to form first and second secondary chambers that each contain fluid and are located in at least one of said forward, middle and rearward areas of said insole, said primary chamber extending in a length dimension of said insole at least from a location corresponding to said forward line to a location corresponding to said rearward line and each of said secondary chambers extending in length and width dimensions leas than said primary chamber, and wherein at least one of said first and second outer layers is joined to said intermediate layer to form a plurality of joints at multiple spaced locations to control flow of fluid within at least one of said primary and secondary chambers.

2. An insole according to claim 1, wherein said first secondary chamber is located in said forward area of said insole and said second secondary chamber is located in said rearward area of said insole.

3. An insole according to claim 2, wherein at least one of said joints is located in said middle area of said insole.

4. An insole according to claim 3, wherein at least one of said joints in said middle area is circular.

5. A insole according to claim 3, wherein at least one of said joints in said middle area is oval.

6. An insole according to claim 3, wherein at least one of said joints has a tear drop shape.

7. An insole according to claim 3, wherein said middle area defines an outer aide edge ad an inner aide edge, and wherein at least one of said joints in said middle area is elongated and extends generally in parallel with said inner side edge.

8. An insole according to claim 3, wherein at least one of said joints in said middle area is elongated and includes an arc portion.

9. An insole according to claim 3, including a third secondary chamber located in said middle area of said insole.

10. An insole according to claim 3, including third and fourth secondary chambers located in said middle area of said insole.

11. An insole according to claim 10, wherein said third and fourth secondary chambers are formed between said second outer layer and said intermediate layer and wherein at least one of said third and fourth secondary chambers contain sufficient fluid that the adjacent second outer layer is convex.

12. An insole according to claim 7, including at least one of said joints in said forward area of said insole and at least one of said joints in said rearward area of said insole.

13. An insole according to claim 12, wherein said forward area also includes a flat toe area at a front end of said insole wherein said first outer layer, said intermediate layer and said second outer layer are bonded together.

14. An insole according to claim 1, wherein each of said first outer layer, said intermediate layer and said second outer layer are made of plastic.

15. An insole according to claim 1, wherein at least one of said first outer layer and said second outer layer are joined to said intermediate layer to provide spaced tongues which extend from said forward line toward said rearward line.

* * * * *